US007445375B2

(12) United States Patent
Kasapi

(10) Patent No.: US 7,445,375 B2
(45) Date of Patent: Nov. 4, 2008

(54) WATCH WITH A TOURBILLON

(75) Inventor: Carole Francoise Danielle Kasapi, La Chaux-De-Fonds (CH)

(73) Assignee: Richemont International SA, Villars-Sur-Glane (CH)

( * ) Notice: Subject to any disclaimer, the term of this patent is extended or adjusted under 35 U.S.C. 154(b) by 0 days.

(21) Appl. No.: 11/339,490

(22) Filed: Jan. 26, 2006

(65) Prior Publication Data

US 2006/0187760 A1 Aug. 24, 2006

(30) Foreign Application Priority Data

Jan. 28, 2005 (CH) ..... 0138/2005

(51) Int. Cl.
*G04B 1/10* (2006.01)
*G04B 15/00* (2006.01)

(52) U.S. Cl. ..... 368/127; 368/142

(58) Field of Classification Search ..... 368/124–127, 368/139–143, 168, 169
See application file for complete search history.

(56) References Cited

U.S. PATENT DOCUMENTS 5,608,694 A * 3/1997 Grimm et al. ..... 368/127
6,402,368 B1 * 6/2002 Grimm et al. ..... 368/127
6,749,333 B2 * 6/2004 Scheufele ..... 368/127
6,890,094 B2 * 5/2005 Dias ..... 368/127

FOREIGN PATENT DOCUMENTS

| | | |
|---|---|---|
| CH | 693 047 | 1/2003 |
| CH | 693 832 | 2/2004 |
| EP | 1 276 022 | 1/2003 |
| EP | 1 465 024 | 10/2004 |
| GB | 2 027 232 | 2/1980 |
| WO | WO 03/017009 | 2/2003 |

OTHER PUBLICATIONS

Richard Good, "Das erste >>Doppel-Tourbillon<<", Alte Uhren, Callway, Muenchen, vol. 2, No. 4, 1979, pp. 245-252, XP008030140.
P. Augereau, "Etude Comparative Entre Le Tourbillon Breguet et le Carrousel du Danois Bonniksen", Jahrbuch der Deutschen Desellschaft fur Chronometrie, vol. 47, 1996, pp. 179-182, XP 000641599.
Richard Good, "The FIrst Tripple Torubillon", Horological Journal, Apr. 1983, pp. 15-19, XP-002124087.
W. Prendel, "An Interesting Tourbillon", Chronometrophilia, 1996.

* cited by examiner

*Primary Examiner*—Vit W. Miska
(74) *Attorney, Agent, or Firm*—Young & Thompson

(57) ABSTRACT

Watch including a movement that incorporates a tourbillon mechanism having a single cage (13, 18, 22) holding the balance (15), this cage (13, 18, 22) rotating about an axis (X—X) forming an angle with the plane of the watch movement. The axis of rotation of the balance (15) forms an angle essentially perpendicular with the axis of rotation (X—X) of the cage (13, 18, 22).

18 Claims, 1 Drawing Sheet

WATCH WITH A TOURBILLON

BACKGROUND OF THE INVENTION

Tourbillon mechanisms for watches have initially been conceived and realised in order to stabilise the rate of the balance by averaging the effects of gravity on the unbalance of the balance. Today balances are well equilibrated, and above all in wrist watches the most important rate variations are caused by amplitude variations of the balance between its horizontal (or flat) and vertical (or pendant) positions. In fact, the amplitude of the oscillations of the balance depends on friction of its shaft in the bearings, the magnitude of these frictions depending on the spatial position of the balance shaft and varying in particular between its vertical and horizontal position.

In an attempt to reduce or average out the effects of the frictional forces acting on the pivots of the balance, new highly complex multiaxial tourbillon systems have been conjured up where the system regulating the watch is made to move within a space of several dimensions relative to a fixed reference system. The Swiss patent CH 693 047, for instance, refers to a watch where the regulating system is housed in a cage executing rotations about a first axis and about a second axis. The patent application EP 1 465 024 A similarly describes a biaxial tourbillon comprising a first conventional cage that contains the balance and the escape pinion, this cage being housed inside a second cage the rotation of which occurs about an axis perpendicular to the axis of rotation of the first cage. However, these tourbillon mechanisms involving two independent rotations of the regulating system remain highly complex and costly for the watch and clockmaker.

SUMMARY OF THE INVENTION

The present invention, to the contrary, in order to compensate for this phenomenon known as the "dial-up—pendant-up" difference, and thus minimise the rate variations, and do so in a simple way, proposes a watch including a tourbillon that is distinguished by the fact that it has a single cage holding the balance and turning in only one direction, and by the fact that the axis of rotation of the balance forms a large angle (that is, an angle of at least 45°) with the axis of rotation of the cage, thus producing the mean value of rates in the different positions relative to D.U. and P.U. The invention offers important advantages when this watch is a wrist watch, since this watch takes up different positions when worn on the wrist.

The invention has the further object of a tourbillon mechanism according to claim 10.

In one embodiment, die axis of rotation of the tourbillon cage forms an angle of 45° with the axis of the winding stem of the watch.

The axis of the balance forms a large angle of at least 45° with the axis of rotation of the cage. This angle, which remains unchanged while the mechanism is functioning, preferably is 90° (the two axes being perpendicular) or essentially close to 90°. Thanks to this important angle between the axis of the balance and the axis of rotation of the cage, a multidirectional displacement of the balance and of its pivots that is able to compensate for the "dial-up—pendant-up" phenomenon mentioned above is gained while only a single cage of rotation is used for the tourbillon.

The axis of rotation of the tourbillon cage forms any angle, that is, an angle going from 0° to 90°, thus comprising the values of 0° and 90°, with the plane of the watch movement into which it is mounted, but this angle is preferably zero or right, that is, parallel or perpendicular to this plane of the movement. This angle remains unchanged while the mechanism is functioning. The tourbillon mechanism of the present invention has only one cage.

BRIEF DESCRIPTION OF THE DRAWING

The single FIGURE of the attached drawing schematically illustrates a partial section of a watch having a tourbillon arranged according to the present invention.

DETAILED DESCRIPTION OF THE INVENTION

Figure 1:
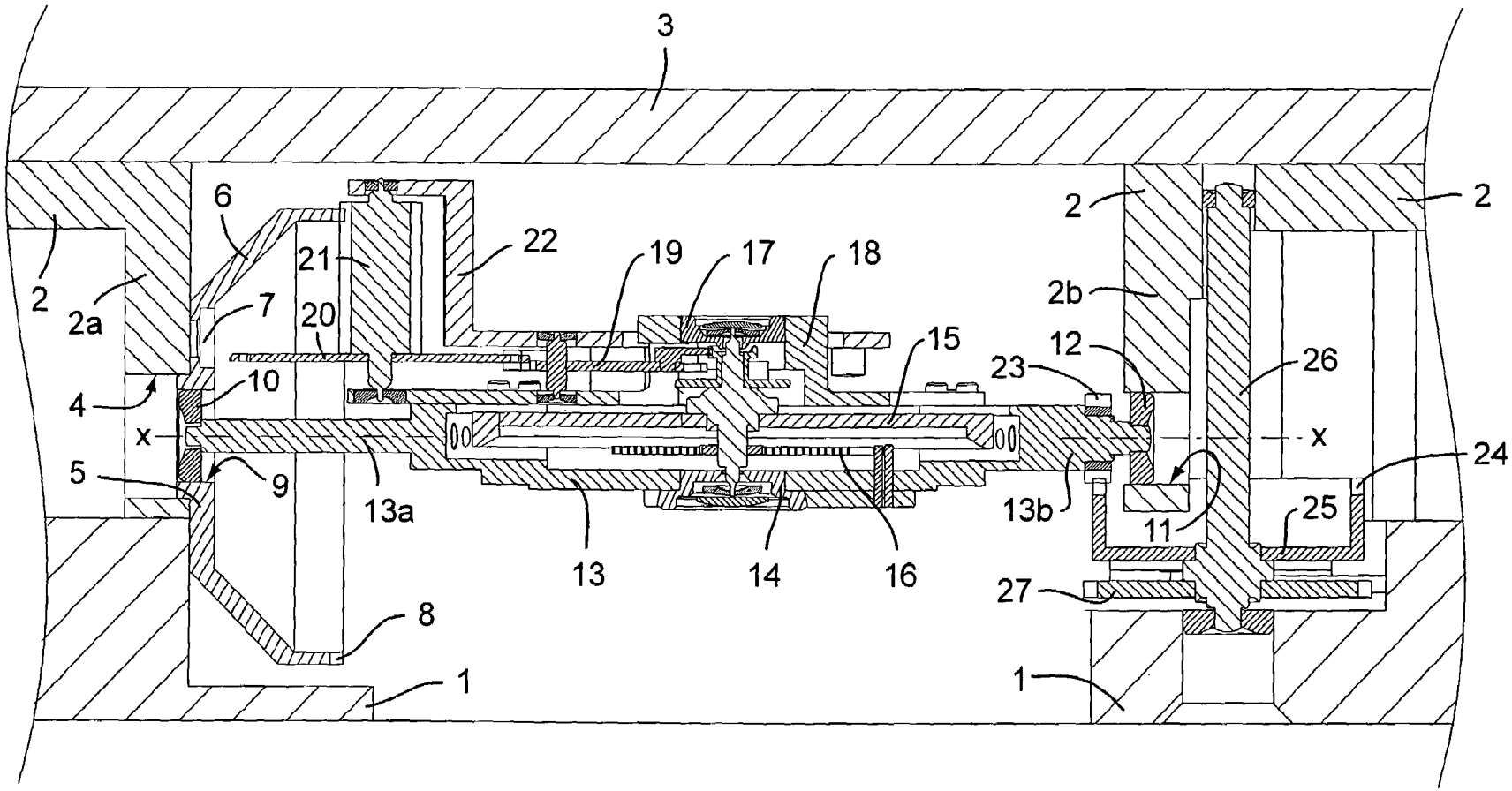

It is seen in the drawing that the watch according to the invention has a lower plate 2 serving as support for a bridge 1 on one side, and for a dial 3 on the other side. Plate 2 has two legs a, b extending perpendicularly to bridge 1 and to plate 2, the end of leg 2*a* resting on the top face of bridge 1.

The end of leg 2*a* has a bore 4 holding the hub 5 of a fixed wheel 6 which, in section, has the shape of a bell, and is fixed at bridge 2 with the aid of at least one screw 7. The teeth 8 of this fixed wheel 6 are sitting on the edge of the bell and extend in a plane perpendicular to dial 3 and bridge 1.

The hub 5 of this fixed wheel 6 is itself provided with a bore 9 holding a first bearing 10 formed by a pierced jewel.

The second leg 2*b* of plate 2 has a bore 11 at its end where a second bearing 12 also formed by a pierced jewel is housed.

The holes of the jewels forming the first and second bearings 10, 12 are aligned and located on an axis X—X parallel to dial 3, to plate 1, and hence to the plane of the watch or clock movement. This axis X—X defines the axis about which the tourbillon cage rotates and, in this embodiment, the angle it forms with the plane of the movement is essentially zero. The axis of rotation X—X of the cage thus is in a plane parallel to plate 2 and/or to dial 1 if the movement has a dial, which is not necessary in all realisations. The angle formed by the axis of rotation X—X of the cage thus is zero relative to the plane of the movement in this embodiment. In variants of embodiments of the mechanism, this axis X—X of rotation of the tourbillon cage may form any angle with the plane of the watch movement into which it is mounted, but this angle will always remain unchanged while the mechanism is functioning. In a particular variant, this angle between axis X—X of the cage and the plane of the movement may be essentially 90°.

The tourbillon has a support 13 provided with two pivots 13*a*, 13*b* one situated in the extension of the other, the ends of which are pivoted in bearings 10, 12, respectively. The middle part of this support holds the lower bearing 14 of the sprung balance 15, 16. The upper bearing 17 of sprung balance 15, 16 sits on an intermediate tourbillon bridge 18 fixed on support 13.

Pallets 19 and the escape wheel and pinion 20, 21 are pivoted between the inter-mediate tourbillon bridge 18 and an upper tourbillon bridge 22 fixed on the tourbillon support 13.

Thus, in the example illustrated the tourbillon cage consists of the support 13 and of the intermediate 18 and upper 22 tourbillon bridges.

The escape wheel and pinion 20, 21 are formed of an escape wheel 20 cooperating with the anchor pallets 19, and of an escape pinion 21 engaged with the teeth 8 of fixed wheel 6.

In the example illustrated, the axis of sprung balance 15, 16 is perpendicular to the axis X—X of rotation of the tourbillon's cage, but in variants this axis of sprung balance 15, 16 could form a different angle, still always large or important, that is, an angle that may have a value of 45 to 90° with this axis X—X of rotation of the cage of the tourbillon in accordance with the invention. In all cases, the angle formed by the axis of the sprung balance, both with the axis of rotation X—X of the tourbillon cage and with the plane of the movement into which the mechanism is mounted, remains unchanged while the mechanism is functioning.

Pivot 13*b* of the support 13 holds a drive pinion 23 engaged with the teeth 24 of a bell-shaped drive wheel 25 fixed to an axis 26 pivoted between plate 2 and bridge 1 of the movement. This drive axis 26 holds a second wheel 27 engaged with the train of the watch.

So as to secure a better efficiency of the gears, the drive wheel 25 and the drive pinion 23 preferably have conical teeth. This also holds for the fixed wheel 6 cooperating with the escape pinion 21.

In such a configuration, cage 13, 18, 22 of the tourbillon rotates about an axis X—X forming a constant angle with the plane of the movement while the sprung balance (as well as its pivots) oscillates in a plane that forms an important angle with the axis of rotation of the tourbillon cage. In this way the dial-up—pendant-up diffferences or variations of rate are reduced, since both in a horizontal position of the watch and in a vertical position of the watch, the rate variations of the sprung balance caused by friction of its bearings are averaged out, as the sprung balance never oscillates in a constant plane. This compensation is most efficient in the case where the axis of rotation of the sprung balance is essentially perpendicular to the axis of rotation of the single tourbillon cage, which is most efficient for the axis of rotation of the sprung balance to be found in various spatial positions for any given position of the watch while this is worn on the wrist. Thus, when the tourbillon cage rotates about an axis parallel to the plane of the watch movement, the tourbillon for instance passes through successive positions CH-3H-CB-9H during one period of rotation, where CH=watch horizontal, face/dial up
3H=watch vertical, face/dial to the left
CB=watch horizontal, face/dial down
9H=watch vertical, face/dial to the right which provides all compensations to the dial-up—pendant-up, in a manner much less complicated than in the multiaxial tourbillons moving in several dimensions that have been described in the past. Moreover, this compensation is achieved with a very simple mechanism.

This tourbillon mechanism can be incorporated into a watch with or without dial, this dial if it exists being situated in a plane parallel to the plane of the watch movement.

The invention claimed is:

1. Watch with a movement incorporating a tourbillon mechanism, characterised in that this tourbillon mechanism has only a single cage (13, 18, 22) holding a balance (15), this cage (13, 18, 22) rotating in only one direction about an axis (X—X) forming a constant angle with the plane of the movement of the watch, and in that the axis of rotation of the balance (15) forms an angle between 45° and 90° with the axis of rotation (X—X) of the cage (13, 18, 22).

2. Watch according to claim 1, characterised in that the axis of the balance (15) is essentially perpendicular to the axis of rotation (X—X) of the cage (13, 18, 22) of the tourbillon.

3. Watch according to claim 1, characterised in that the axis of rotation (X—X) of the cage (13, 18, 22) of the tourbillon is parallel to the plane of the movement of the watch, while the angle which it forms with the plane of the movement is essentially zero.

4. Watch according to claim 1, characterised in that the cage of the tourbillon (13, 18, 22) also holds pallets (19) and an escape wheel and pinion (20, 21), and in that the escape pinion (21) is engaged with the teeth (8) of a fixed wheel (6).

5. Watch according to claim 4, characterised in that the fixed wheel (6) is coaxial with the axis of rotation (X—X) of the cage (13, 18, 22) of the tourbillon.

6. Watch according to claim 1, characterised in that it includes a drive wheel and pinion (25, 26, 27) driven by the train of the watch movement; in that this drive wheel and pinion (25, 26, 27) is pivoted following an axis perpendicular to the axis of rotation (X—X) of the cage (13, 18, 22) of the tourbillon; and in that this drive wheel and pinion (25, 26, 27) includes a drive wheel (25) the teeth (24) of which cooperate with a drive pinion (23) fixed to the axis (13, 13*a*, 13*b*) of the tourbillon cage.

7. Watch according to claim 1, characterised in that the axis of rotation (X—X) of the cage of the tourbillon (13, 18, 22) forms an angle of 0 to 90° with a winding stem of the movement of the watch.

8. Watch according to claim 1, characterised in that the axis of rotation (X—X) of the cage (13, 18, 22) of the tourbillon forms an angle of 45° with a winding stem of the movement of the watch.

9. Watch, according to claim 1, characterised in that it consists of a wrist watch.

10. Tourbillon mechanism for a watch according to claim 1, including the single tourbillon cage (13, 18, 22) holding the balance (15) and an escape wheel and pinion (20, 21), characterised in that the pinion (21) of the escape wheel and pinion is engaged with a fixed wheel (6).

11. Tourbillon mechanism according to claim 10, characterised in that the fixed wheel (6) is coaxial with the axis of rotation (X—X) of the cage (13, 18, 22) of the tourbillon.

12. Tourbillon mechanism according to claim 10, characterised in that the axis (X—X) of the cage (13, 18, 22) of the tourbillon holds a drive pinion (23) engaged with the teeth (24) of a drive wheel (25) pivoted about an axis perpendicular to the axis (X—X) of rotation of the cage (13, 18, 22) of the tourbillon.

13. Tourbillon mechanism according to claim 10, characterised in that the fixed wheel (6) and the drive wheel (25) in section exhibit the general shape of a bell.

14. Tourbillon mechanism according to claim 10, characterised in that the fixed wheel (6) cooperates with the escape pinion (21) via conical teeth, and in that a drive wheel (25) cooperates with the drive pinion (23) via conical teeth.

15. Watch according to claim 2, characterised in that the axis of rotation (X—X) of the cage (13, 18, 22) of the tourbillon is parallel to the plane of the movement of the watch, while the angle which it forms with the plane of the movement is essentially zero.

16. Tourbillon mechanism according to claim 11, characterised in that the axis (X—X) of the cage (13, 18, 22) of the tourbillon holds a drive pinion (23) engaged with the teeth (24) of a drive wheel (25) pivoted about an axis perpendicular to the axis (X—X) of rotation of the cage (13, 18, 22) of the tourbillon.

17. Tourbillon mechanism according to claim 11, characterised in that the fixed wheel (6) and a drive wheel (25) in section exhibit the general shape of a bell.

18. Watch having a case with a movement incorporating a tourbillon mechanism, characterised in that this tourbillon mechanism has a single cage (13, 18, 22) holding a balance (15) and an escape wheel and pinion (20, 21), this cage (13, 18, 22) rotating about an axis (X—X) forming a constant angle with the plane of the movement of the watch, and in that the axis of rotation of the balance (15) forms an angle between 450 and 900 with the axis of rotation (X—X) of the cage (13, 18, 22), wherein the escape pinion (21) directly engages with the teeth of a wheel (6), fixed relative to said case.

* * * * *